US007571631B2

(12) United States Patent
Moskowitz et al.

(10) Patent No.: US 7,571,631 B2
(45) Date of Patent: Aug. 11, 2009

(54) METHOD OF MANUFACTURING A WOODWORKER'S HOLDFAST

(75) Inventors: Joel Moskowitz, New York, NY (US); Richard Lombardi, Staten Island, NY (US); George Randolph Nick, Sussex, WI (US)

(73) Assignee: 01 Inc., New York, NY (US)

( * ) Notice: Subject to any disclaimer, the term of this patent is extended or adjusted under 35 U.S.C. 154(b) by 127 days.

(21) Appl. No.: 11/502,113

(22) Filed: Aug. 9, 2006

(65) Prior Publication Data

US 2007/0062242 A1 Mar. 22, 2007

(51) Int. Cl.
*B21D 11/00* (2006.01)
*B21D 9/05* (2006.01)
*B23Q 3/00* (2006.01)

(52) U.S. Cl. ..... 72/306; 72/388; 269/289 R; 269/291

(58) Field of Classification Search ..... 72/149, 72/159, 306, 307, 318, 388, 135, 380, 386, 72/387; 269/143, 249, 289 R, 291, 24; 144/253.1–252.91, 144/285–287
See application file for complete search history.

(56) References Cited

U.S. PATENT DOCUMENTS 4,202,082 A * 5/1980 Williams ..... 29/898.051
6,341,517 B2 * 1/2002 Benes et al. ..... 72/306

* cited by examiner

*Primary Examiner*—Dana Ross
*Assistant Examiner*—Teresa Bonk
(74) *Attorney, Agent, or Firm*—Abelman, Frayne & Schwab

(57) ABSTRACT

A semi-automated method for manufacturing a woodworker's holdfast tool from an unheated length of mild steel rod includes forging a flattened contact surface at one end of the rod and subsequently bending the rod upwardly away from the contact surface and forming the crook portion in an automated wire forming machine configured to exceed the desired working angle during cold forming of the crook portion to account for the resilience of the rod when the bending force is removed.

15 Claims, 3 Drawing Sheets

1
2
8
12
13
14
16
18
19
22
24
30
32
34
42
44
50
$F_b$
$F_r$

FIG. 3
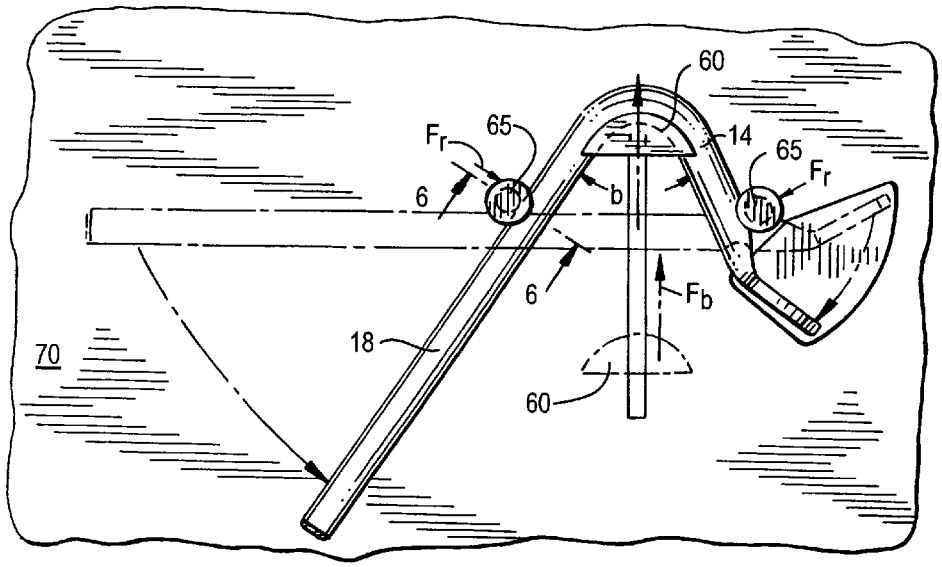
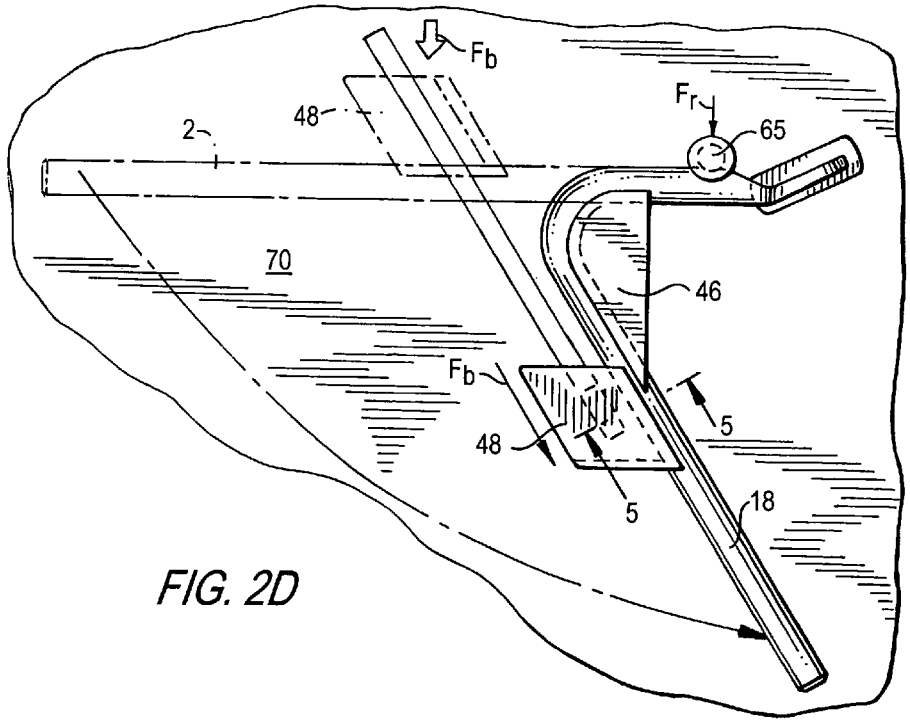
FIG. 2D

METHOD OF MANUFACTURING A WOODWORKER'S HOLDFAST

FIELD OF THE INVENTION

This invention relates to a semi-automatic method for the manufacture of a woodworker's bench tool known as a holdfast.

BACKGROUND OF THE INVENTION

A holdfast is a woodworker's tool used to quickly and temporarily secure a workpiece to the surface of a workbench during operations such as planing or shaping of the workpiece. The holdfast is customarily formed from round stock and has a flattened contact surface at one end known as the beak or pad that is positioned on the upper surface of the workpiece. A generally straight portion known as the arm extends upwardly at an acute angle to the pad's planar surface. An intermediate curved portion referred to as the crook terminates in a straight shaft portion known as the stem that is secured by frictional contact with the interior surface of a vertical hole bored in the top of the workbench. The hole in the workbench is somewhat larger in diameter than the stem of the holdfast. The angle formed by the longitudinal axis of the shaft or stem portion and the plane formed by the contact surface of the beak is less than 90° and is referred to in the description and claims that follow as the "predetermined working angle".

This relative configuration of the elements allows the shaft of the holdfast to effectively be wedged into a vertical hole bored through the top of the bench. The holdfast is tightened onto the work piece by tapping the upper end of the shaft or stem with a hammer or mallet and released by tapping the side of the shaft.

Holdfasts have been produced by blacksmiths using conventional techniques for heating, flattening and shaping the several portions. Forging a holdfast is time-consuming and therefore expensive.

Holdfasts have also been produced by casting the entire tool as a single piece. Castings are both brittle and do not flex in the manner of a forged metal tool.

It is therefore an object of the present invention to provide a method for efficiently and reproduceably manufacturing holdfasts of various sizes that is economical and that can be readily adapted to permit modifications to the configuration of the finished articles.

SUMMARY OF THE INVENTION

The above objects and other advantages are achieved by the method of the invention in which a straight rod or bar of mild steel is cold formed into a holdfast using commercially available wire forming equipment. The utilization of a wire forming machine allows the apparatus to be set up to accurately and reliably reproduce holdfasts having a predetermined desired configuration without application of heat or the hand labor associated with hot forging of the articles. The economy comes in the ability to mass-produce holdfasts that meet a predetermined specification and desired tolerances.

The invention broadly comprehends a method of producing a holdfast having a predetermined working angle from a length of unheated old-formed mild steel rod comprising the steps of:

a. forming a flattened end portion having a contact face that is tangential to the adjacent surface of the rod;

b. providing an automated wire forming machine with a plurality of fixed and moving rod-contacting surfaces for engaging the unflattened portion of the rod;

c. advancing the rod into the wire forming machine;

d. actuating the wire forming machine to bring a first portion of the rod that is proximate the flattened portion and opposite the contact face against a stationary first fulcrum member and applying a first forming force to the side of the rod on which the contact face is formed to thereby form an offset angle;

e. contacting a second portion of the rod that is intermediate the flattened end and the opposite free end with a second arcuate fulcrum member and applying a forming force to the free end of the rod to thereby form a crook in an intermediate portion of the rod, said crook-forming force being sufficient to form a temporary working angle in the holdfast, that is less than the predetermined working angle;

f. reducing the forming forces and moving the fulcrum members from contact with the holdfast, whereby the tensile forces on the crook portion are released and the holdfast relaxes to the predetermined working angle.

In one preferred embodiment of the method, the beak is formed in a punch press and any cold forming cracks or fissures in the periphery are eliminated by die cutting and removing the cracked portion. A disc grinder can be utilized in either a manual or automated operation. Thereafter, the rod having one flattened end portion is subjected to two bending operations.

As previously noted, the holdfast is preferably produced from a length of mild steel in the form of a round rod. It is also possible to use a rod that is hexagonal or octagonal in cross-section; however, such shapes can deform the workbench openings and provide a less secure fractional holding force.

The rod can be from about one-half (½) inch to one and one-quarter (1.25) inches in diameter. It will be understood that the holes provided in the workbench for receiving the shaft of the holdfast are somewhat larger in order to provide the desired angular relation that produces the frictional forces to retain the holdfast once it is tapped into position. It is customary to provide workbenches with three-quarter (¾) inch holes for receiving the holdfast and a rod having a diameter of 23/32 of an inch is satisfactory.

As will be understood by one of ordinary skill in the art, the geometrical relationship between the diameter of the rod, the diameter of the workbench hole and the predetermined working angle are interrelated and can be modified to provide a secure retaining fit when a downward striking pressure is applied to the top of the holdfast after placing the beak on the workpiece. As will also be understood by those of ordinary skill in the art, the reach, or the distance from the outermost part of the beak to the inside of the stem, can be varied. A reach of from about six (6) to about twelve (12) inches will accommodate a wide variety of workpieces.

Various types of wire forming apparatus known to the art can be utilized in the practice of the invention. In one preferred embodiment, a sixty-ton Accupress® #7606 forming machine from Accupress, Inc. of Willmar, Minn. is employed to form the bend at the beak. A Diacro HydraPower Bender #8 can be employed to form the crook.

The production of holdfasts in accordance with the method of the invention can be further automated by utilizing a rod feeding device as described, for example, in U.S. Pat. No. 6,341,517, the disclosure of which is also incorporated herein by reference. The section of rod from which the holdfast is formed can be supported and maintained in fixed relation to the bed of the forming apparatus by a securing device which, optionally, can also rotate the rod around its longitudinal axis to obtain the desired orientation for the bending step(s). Apparatus for securing the rod in a holding chuck prior to bending is also described in U.S. Pat. No. 6,434,995, the disclosure of which is also incorporated herein by reference.

The use of a securing device or a chuck that grips the straight end portion of the rod permits the rod to be held above the bed a distance that accounts for the additional width of the flattened beak. Alternatively, a channel or recess can be provided in the bed of the forming machine to accommodate the additional width during bending of the rod. In yet another alternative embodiment, the beak is formed after the rod is bent.

The forming of the bends in the rod can be accomplished by applying an appropriately curved convex former to the inside of the rod while stationary posts hold the rod against the force applied. The former can be moved by an hydraulic ram or other conventional means. One suitable arrangement of the apparatus is described in U.S. Pat. No. 4,254,651, the disclosure of which is incorporated herein by reference in its entirety. An apparatus for forming the rod while it is moving is described in U.S. Pat. No. 4,008,595, the contents of which are also incorporated herein by reference.

Another suitable forming apparatus is described in U.S. Pat. No. 4,335,758 and includes an automated control system in which a movable block engages the rod and forces the rod against a fixed anvil having a predetermined curvilinear surface to provide the desired configuration to the finished bend. As will be understood by those of ordinary skill in the metal working art, it will be necessary to move the rod to form a slightly smaller angle during the force application stage to achieve the desired finished angle to account for the small rebound that will occur when the force is removed.

In the cold forming of the beak, the rapid deformation of the metal in the punch press can result in the formation of small cracks extending inwardly from the free end. These can be removed in a shearing operation, but die cutting is preferred in order to provide a curved shape; final finishing, including chamfering can be accomplished with a disc grinder in a manual or automated operation. The opposite end of the rod is also preferably chamfered at the same stage, although these grinding operations can be done at any time.

BRIEF DESCRIPTION OF THE DRAWINGS

The invention will be further described with reference to the attached drawings in which the same or similar elements are identified with the same number, and in which FIG. 1 is a top, front, left perspective view of partly in section, of a pair of holdfasts securing a workpiece to the surface of a workbench;

FIGS. 2A through 2D represent a stepwise progression of the manufacture in accordance with the method of the invention where FIG. 2A is a perspective view of a length of mild steel rod cut for use in the method of the inventor;

FIG. 2B is a side elevation view of the step of forming the beak with a punch press;

FIG. 2C is a side elevation schematic illustration of the step of bending the rod at the beak;

FIG. 2D is a top plan view schematically illustrating the step of bending the rod to form the crook;

FIG. 3 is a schematic illustration of the set up of a wire forming machine for the practice of one alternative embodiment of the invention.

DETAILED DESCRIPTION OF THE PREFERRED EMBODIMENT

Figures 1, 2A, 2B, 2C:
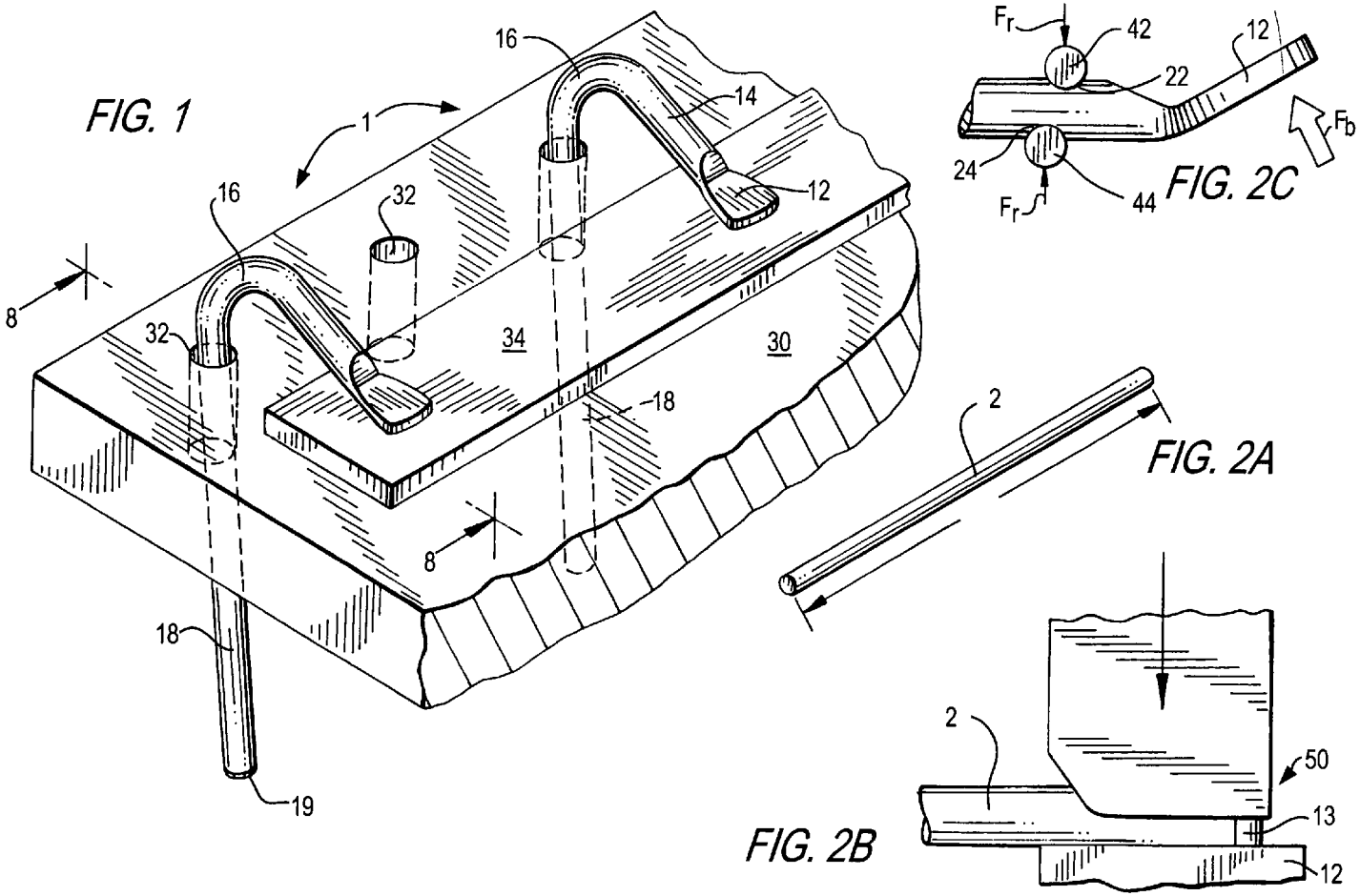

Referring now to FIG. 1, a typical holdfast (1) is illustrated in position and includes a pad or beak (12), an arm (14), a curved portion referred to as the crook (16) and the stem or shank (18), that is placed in a vertical hole (32) drilled in a workbench (30). The flat underside of the beak (12) is placed in contact with the upper surface of a workpiece (34) and the crook portion is tapped with a hammer to wedge the stem (18) firmly in the slightly larger diameter hole (32). The set position is also clearly shown in FIG. 7.

The method will be described with reference to FIGS. 2A-2D in which a predetermined length of steel rod (2) is cut for use in the process. In one embodiment, the length of steel rod is about 45 cm. As illustrated in FIG. 2B, one end is flattened, e.g., in a punch press (50) to form the beak (12), the underside of which is preferably tangential to the adjacent portion of the rod (2). In one embodiment, the end portion of the rod is flattened by a single impact. It will also be understood that the beak can be formed as a subsequent intermediate step or as the final step in the process. In one embodiment, the thickness of the flattened end portion is about 33% the diameter of the rod.

As previously noted, the cold forming of the beak can produce small cracks in the free end (13) which can be conveniently removed by shearing and/or die cutting to form a curved end that can be finished by grinding to form a smooth and preferably chamfered edge. The opposite end of the rod (2) is also preferably finished with a chamfered surface for comfort of handling and ease of inserting and removing the stem (18) from the workbench opening.

Figure 5:
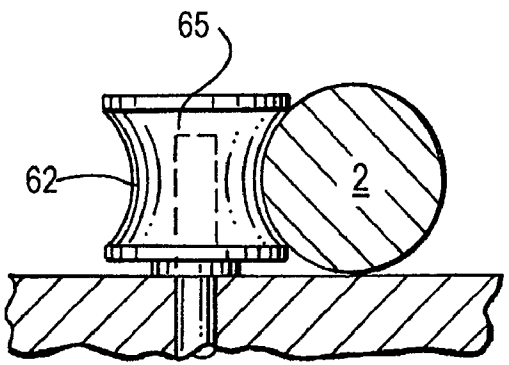
FIG. 5 is a side elevation view, partly in section, taken along line 6-6 of FIG. 3.
Figure 4:
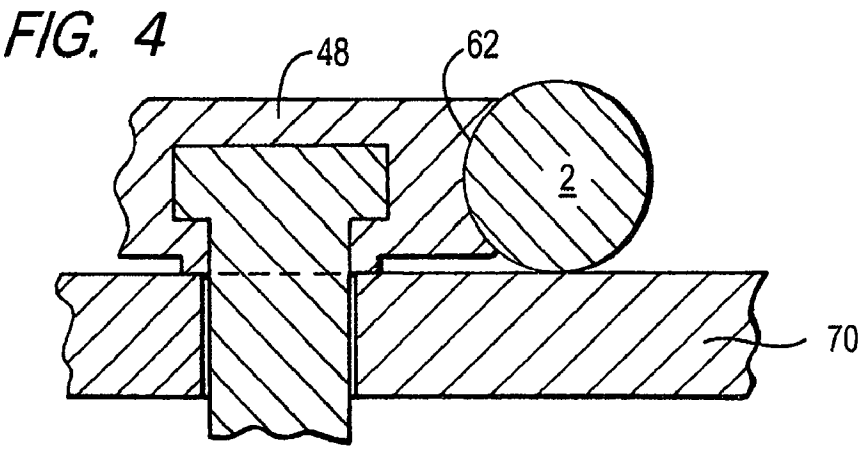
FIG. 4 is a side elevation sectional view taken along line 5-5 of FIG. 2D.

As shown in FIG. 2C, the angular offset "a" between the beak (12) and arm (14) is produced in a wire forming machine. This step can be performed by applying a force $F_b$ to create a bending moment around fixed bending pin (42) in the bed of wire forming machine (40), with fixed restraining pin (44). As shown in FIG. 2C, tooling marks in the form of indentations (22, 24) on the opposing surfaces of the rod and corresponding to the fixed pins (42, 44) are caused by the relatively large forces $F_r$ applied to a small area of the mild steel rod. These distinctive tooling marks can be minimized or essentially eliminated by replacing the small diameter pins with tooling that has a concave surface corresponding to the exterior surface of the rod, and extending along the curvature of the bend and the straight portion, e.g., as illustrated in FIGS. 4 and 5. The particular type of tooling selected is not critical and forms no part of the claimed invention.

Referring now to FIG. 2D, the crook (16) is preferably formed around a curved section of tooling (46) by applying a force $F_b$ to stem 18 via tooling member 48, while applying a restraining force $F_r$ to arm (14) with stationary member 65.

Figure 6:
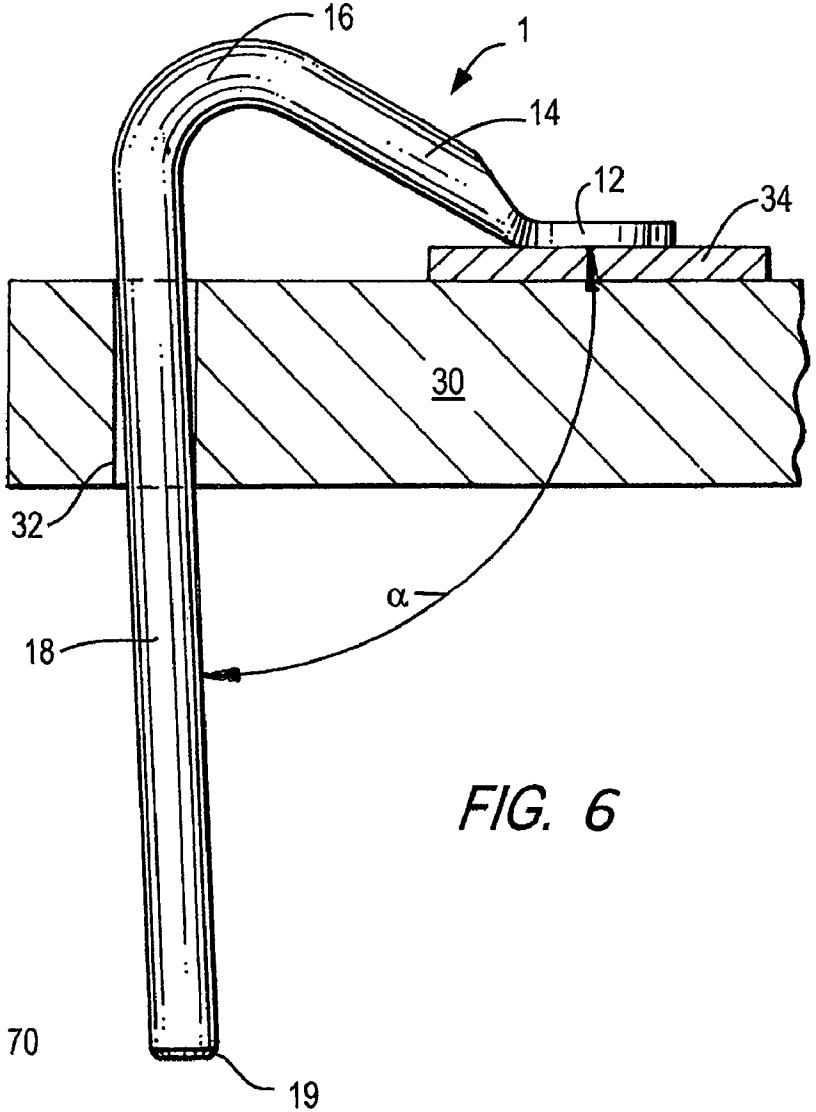
FIG. 6 is a side elevation view of a holdfast taken along section 8-8 of FIG. 1.

A setup of tooling for a wire forming machine (70) for practicing the invention is schematically illustrated in FIG. 3. In this embodiment, the moving tooling member (60) has a concave arcuate surface (62) that matches the outer curvature of the rod (2). This is illustrated for the associated stationary forming members (65) that are shown in FIG. 5. The angular degree of the temporary working angle "b" defined by tooling member (60) is somewhat smaller than the predetermined working angle "a" as defined by the arm (14) and stem (18) extending from crook (16), as best shown in FIG. 6, to account for the rebound of the cold formed steel when the forces of bending $F_b$ and/or restraining $F_r$ are removed. In this embodiment, stationary members (65) are mounted for rotation as the rod assumes the curvature of the crook (16). In one embodiment, the temporary working angle "b" of the holdfast during forming is about 5° less than the predetermined working angle "a" of the finished holdfast.

With reference to FIG. 6, it will be understood that the overall size and proportions of the holdfast will vary with the use to which it is to be applied, all of which will be known to those of ordinary skill in the art. The predetermined working angle "a" can range from about 80° to 87° or even larger. The distance from the outer end of the beak (12) to the stem (18) can be about 6 inches in order to provide space for tool access during treatment of the workpiece. It will also be understood that the angle formed by the crook can be greater than 90°, so long as the frictional fit can be achieved by the stem in the workbench hole (32), which is typically ¾".

In the preferred embodiment of the practice of the method, the metal rod is not heated and following the stepwise treatment described above, the holdfast is ready for use, or sale by the manufacturer. In an alternate embodiment, the rod can be heated uniformly or locally at the specified positions where the metal is to be flattened and/or bent in order to reduce the bending and restraining forces $F_b$ and $F_r$. It may then be necessary to further treat the finished article to temper the steel to provide the desired resilience during use. As will be apparent to one of ordinary skill in the art, the steps of heating and any post-forming treatment(s) will add to the cost and time of production of the holdfast. For these reasons, the cold-forming method as described is preferred.

The various embodiments are illustrative of the method of practicing the invention and it will be apparent to those of ordinary skill in the art from this description that further modifications and variation can be undertaken and the scope of the protection to be accorded the invention is to be determined with reference to the claims that follow.

We claim:

1. A method of producing a woodworker's holdfast from a predetermined length of mild steel rod, the holdfast having a flattened end portion formed at a predetermined working angle, the end portion being joined to a straight portion by an intermediate curved portion, the method comprising the steps of:

a. forming the flattened end portion having a contact face that is tangential to an adjacent surface of the rod from which it is formed;

b. providing an automated wire forming machine with a plurality of fixed and moving rod-contacting surfaces for engaging unflattened portions of the rod;

c. advancing the rod into the wire forming machine;

d. actuating the wire forming machine to bring a first portion of the rod that is proximate the flattened end portion and opposite the contact face against a fixed pin tooling member and applying a first forming force to the side of the rod on which the contact face is formed to thereby form an offset angle;

e. contacting a second portion of the rod that is intermediate the flattened end and an opposite free end with a curved tooling member and applying a linear crook-forming force to the free end of the rod to thereby form a crook in an intermediate portion of the rod, said crook-forming force being sufficient to form a temporary working angle in the holdfast, that is less than the predetermined working angle;

f. reducing the forming forces and moving the tooling members from contact with the holdfast, whereby the forming forces on the crook portion are released and the holdfast relaxes to the predetermined working angle.

2. The method of claim 1, wherein the fixed pin tooling member is a cylindrical member.

3. The method of claim 2, wherein the first forming force is applied by contacting the rod with a cylindrical member, whereby the opposing surfaces of the rod contacted are formed with corresponding indentations.

4. The method of claim 1, wherein the surfaces of the wire forming machine that contact the rod with shaping forces are contoured to mate with the exterior contour of the rod's surface.

5. The method of claim 1, wherein the mild steel rod has a circular cross-section and a diameter that is in the range from 12 mm to 32 mm.

6. The method of claim 1, wherein the predetermined work angle of the holdfast is in the range of from 81° to 87°.

7. The method of claim 1, wherein the temporary working angle of the holdfast during forming in step (e) is about 5° less than the predetermined working angle of the holdfast.

8. The method of claim 1, wherein the end portion is flattened by a single impact.

9. The method of claim 1, wherein the thickness of the flattened end portion is about 33% the diameter of the rod.

10. The method of claim 1, wherein the length of the steel rod is about 45 cm.

11. The method of claim 1, which includes the further step of chamfering the edges of the flattened end portion and of the circumference of the opposite end of the rod.

12. A holdfast manufactured in accordance with the method of claim 1.

13. The method of claim 1, wherein said linear crook-forming force is applied at a same location of the rod where the crook is formed.

14. The method of claim 13, wherein said linear crook-forming force is applied to the rod while two stationary posts hold the rod against the force applied.

15. The method of claim 13, wherein said liner crook-forming force is applied with a hydraulic ram.

* * * * *

UNITED STATES PATENT AND TRADEMARK OFFICE

CERTIFICATE OF CORRECTION

PATENT NO. : 7,571,631 B2
APPLICATION NO. : 11/502113
DATED : August 11, 2009
INVENTOR(S) : Moskowitz et al.

It is certified that error appears in the above-identified patent and that said Letters Patent is hereby corrected as shown below:

Title page,
after item (65) insert -- Related U.S. Application Data
(60) Provisional application No. 60/718,598, filed on September 20, 2005. --

Column 1,
in line 3, after "HOLDFAST" and before "FIELD" insert
-- CROSS REFERENCE TO RELATED APPLICATIONS
This application claims the benefit of U.S. Provisional Application Ser. No. 60/718,598 filed September 20, 2005. --

Signed and Sealed this

Twenty-ninth Day of September, 2009

David J. Kappos

David J. Kappos
*Director of the United States Patent and Trademark Office*